US005996302A

United States Patent [19]

Choisel

[11] Patent Number: 5,996,302

[45] Date of Patent: Dec. 7, 1999

[54] DEVICE FOR ASSEMBLING TOGETHER SUPERPOSED WOODEN PLANKS TO CONSTITUTE A WALL PANEL

[76] Inventor: Daniel Choisel, 116 Les Hauts Buissons, 28100 Dreux, France

[21] Appl. No.: 09/038,043

[22] Filed: Mar. 11, 1998

[30] Foreign Application Priority Data

Apr. 17, 1997 [FR] France ..... 97 04760

[51] Int. Cl.[6] ..... E04B 2/08

[52] U.S. Cl. ..... 52/586.1; 52/589.1; 52/585.1; 52/582.1; 52/233

[58] Field of Search ..... 52/586.1, 585.1, 52/233, 582.1, 589.1; 403/294, 292, 174, 178

[56] References Cited

U.S. PATENT DOCUMENTS

| | | | |
|---|---|---|---|
| 2,787,029 | 4/1957 | Johnson | 52/233 |
| 3,218,097 | 11/1965 | Bowers et al. | 403/292 |
| 3,767,233 | 10/1973 | Hodge | 403/292 |
| 3,884,002 | 5/1975 | Logie | 403/292 |
| 5,577,356 | 11/1996 | Hubbard et al. | 52/233 |
| 5,741,083 | 4/1998 | Schvartz | 403/292 |
| 5,787,675 | 8/1998 | Futagi | 52/745.1 |

FOREIGN PATENT DOCUMENTS

| | | | |
|---|---|---|---|
| 574490 | 7/1988 | Australia . | |
| 617935 | 4/1961 | Canada | 52/233 |
| 1400245 | 9/1965 | France . | |
| 2556022 | 6/1985 | France . | |
| 2 682 974 | 4/1993 | France . | |
| 3229262 | 2/1984 | Germany . | |
| 3703741 | 8/1988 | Germany . | |
| 9404109 | 5/1994 | Germany . | |

*Primary Examiner*—Carl D. Friedman
*Assistant Examiner*—Dennis L. Dorsey
*Attorney, Agent, or Firm*—Griffin, Butler, Whisenhunt & Szipl, LLP

[57] ABSTRACT

The invention relates to a device for assembling together at least one series of wooden planks, each having two opposite ends and two opposite longitudinal edges, with the planks being superposed edge-to-edge to form a wall panel. The device comprises a vertical upright fitted with fastener means for fastening the upright to one of the two ends of each plank, the fastener means comprising, for each series of superposed planks, a series of tenons extending perpendicularly to the vertical upright in a common vertical plane to co-operate with mortises formed in the corresponding ends of the planks. The vertical upright is made up of a plurality of segments connected end to end and each fitted with at least one of the tenons in each series of tenons.

10 Claims, 5 Drawing Sheets

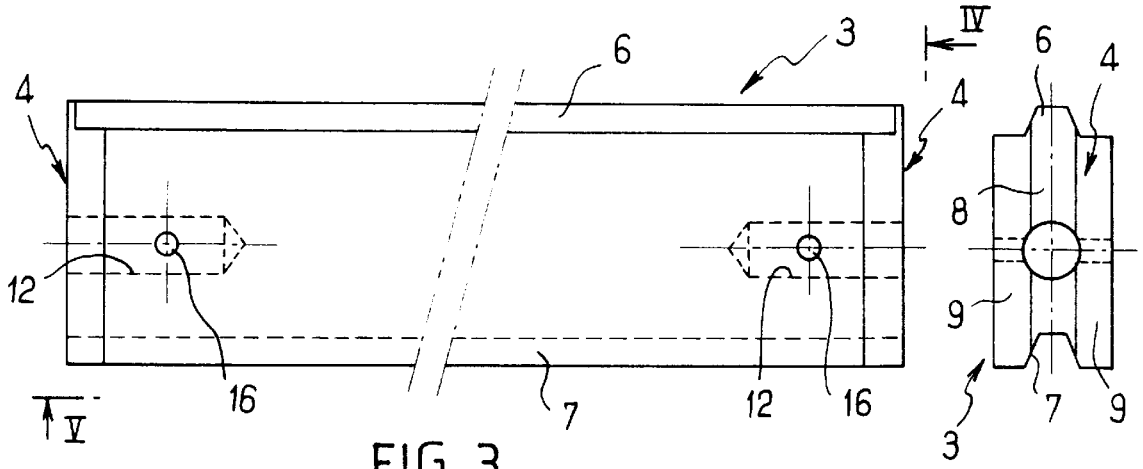
FIG_3
FIG_4
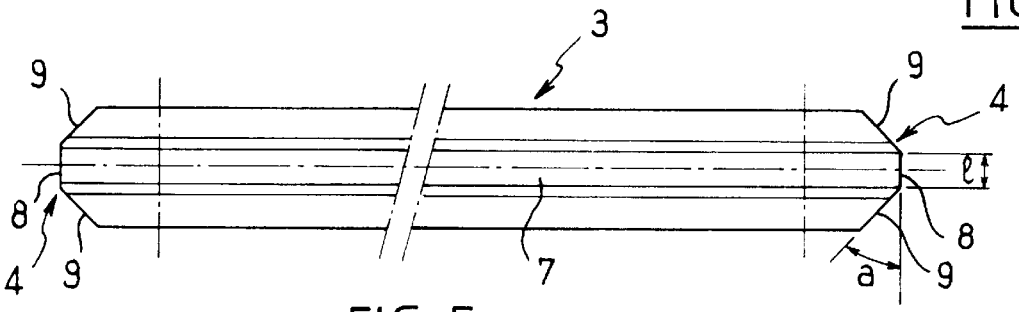
FIG_5
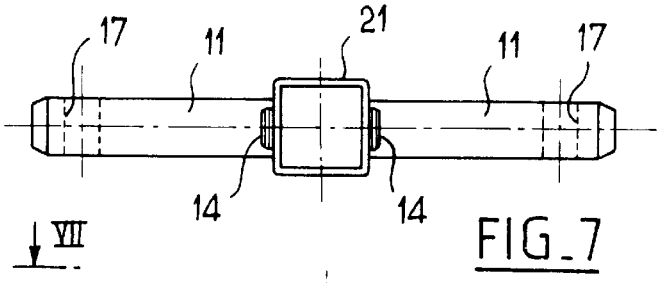
FIG_7
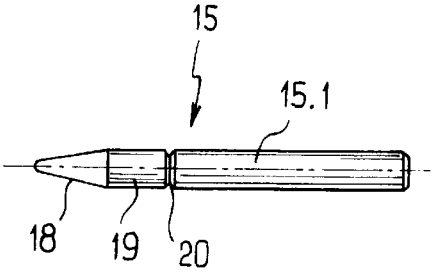
FIG_8
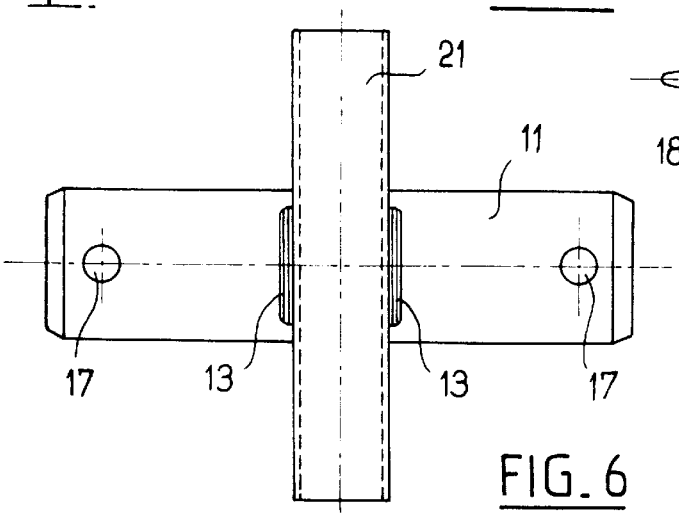
FIG_6

DEVICE FOR ASSEMBLING TOGETHER SUPERPOSED WOODEN PLANKS TO CONSTITUTE A WALL PANEL

The invention relates to a device for assembling together superposed wooden planks to constitute a wall panel of a building.

BACKGROUND OF THE INVENTION

Some buildings, such as chalets, garages, shelters, or barns, possess wall panels (for outside or inside walls) that are constituted by assembling together a series of elongate wooden planks of substantially rectangular section which are placed horizontally in a vertical plane and which are superposed edge to edge. Panels made in this way are juxtaposed and interconnected in line with one another via their side edges so as to form a continuous wall, or else at right angles (using L, T, and X brackets).

Superposed planks can be assembled together and panels formed by superposed planks can be fastened together by an ancient method of half-thickness lapping which consists in forming notches in the ends of the planks and in engaging the ends of adjacent planks so that the notches are received in one another.

More recently, special assembly devices have been proposed to reduce building costs and to improve the mechanical characteristics of a building. Such assembly devices comprise mainly vertical uprights fitted with means for fastening the ends of planks to the uprights.

In particular, from French patent No. 2 682 974, a device is known in which each vertical upright is a continuous section member, and the means for fastening the upright with each series of planks forming the same panel are implemented in the form of a vertical slideway obtained by recessing one of the faces of the vertical upright and by engaging the end of each plank therein. The planks are thus stacked edge to edge to form a wall panel. A plurality of slideways can be provided on different faces of the vertical upright so as to assemble together a plurality of series of superposed planks constituting a plurality of wall panels which are thus connected together at an angle or in line with one another.

A drawback of that device lies in the fact that the wall formed by the stack of edge-to-edge planks is subjected to the large dimensional variations undergone by the wood constituting the planks as a function of atmospheric conditions, and in particular as a function of the degree of humidity of the ambient air. Since wood fibers are mainly longitudinal, these dimensional variations are particularly perceptible across the planks, i.e. vertically.

Also known, from document FR 2 556 022, is an assembly device in which the means for linking the vertical upright with the planks are implemented in the form of a series of tenons secured to the vertical upright and extending perpendicularly therefrom in a common vertical plane to co-operate with mortises formed in the corresponding ends of the planks.

That kind of device makes it possible for the wall panel constituted by each stack of planks to be insensitive to the dimensional variations of the wood as a function of atmospheric conditions.

The superposed planks are no longer stacked one on another, but on the contrary they are secured in vertical position to the vertical upright by means of the tenons with which they are associated. The vertical pitch of the planks is thus determined by the pitch of the tenons, thereby leaving the planks to move independently from one another, expanding or contracting freely depending on atmospheric conditions and without such dimensional variations affecting the wall panel they constitute. In addition, this makes it possible to build a building that is several stories high.

Nevertheless, a major drawback remains: it can be difficult to assemble the vertical upright to the planks. In particular, it is not practical on site to envisage installing a wooden plank between two vertical uprights that are already secured to the ground without providing other arrangements, such as a notch formed in one of the ends of the plank to give the tenon lateral access to the corresponding mortise. However, such arrangements increase manufacturing costs and run the risk of weakening the structure.

OBJECTS AND SUMMARY OF THE INVENTION

An object of the invention is to provide an assembly device using mortise and tenon type fastening, that makes assembly quick and easy while retaining good mechanical performance.

To achieve this object, the invention provides a device for assembling together at least one series of wooden planks each having two opposite ends and two opposite longitudinal edges, which planks are superposed edge-to-edge to make up a wall panel, the device comprising a vertical upright fitted with fastener means for fastening said upright to one of the two ends of each plank, said fastener means comprising, for each series of superposed planks, a series of tenons extending perpendicularly to the vertical upright in a common vertical plane to co-operate with mortises formed in the corresponding ends of the planks, in which device the vertical upright is made up of a plurality of segments disposed end to end and each fitted with at least one of the tenons in each series of tenons.

It is thus possible to prepare each segment with its associated plank(s) prior to placing the segment on the lower segment that is already in place. Thus, in particular, the tenons on each segment can be inserted in the mortises of the associated plank(s) manually without any special arrangements needing to be provided on the planks. In addition, each segment constitutes a multipurpose assembly element enabling a vertical upright to be made to a height that is adapted to circumstances.

In a first embodiment, each of the segments is tubular and is engaged on a rod forming a core that is common to all of the segments. The vertical upright obtained in this way possesses particularly high mechanical strength. In addition, the segments and the rod can be manufactured simply and cheaply.

In a second embodiment, each of the segments has two complementary engagement ends. This makes it particularly quick and simple to assemble the vertical upright.

In which case it is then advantageous for each segment to be tubular and to receive in one of its two ends part of a stud which has one part securely mounted in the end of the segment and another part which projects from the segment to be engageable in the other end of the adjacent segment.

According to an advantageous characteristic of the invention, each tenon is retained in the mortise of the corresponding plank by a pin passing through holes formed substantially in register in the plank and in the tenon. This improves the stiffness and the stability of the assembly.

In which case, the holes in the tenon and in the plank are slightly offset and the pin has a conical end. On assembly, the conical end of the pin performs a camming function which forces the holes in the tenon and the plank into alignment, thereby causing the end of the plank to be pressed tightly with determined prestress against the vertical upright.

According to a second advantageous characteristic of the invention, the mortises formed in the ends of the planks are implemented as cylindrical bores, and the tenons of the vertical upright are implemented in the form of flat lugs disposed in a plane parallel to the vertical upright. This provides an assembly device which is stiff, easy to manufacture, and easy to assemble.

According to a third advantageous characteristic of the invention, the vertical upright has a plane face from which the tenons project, and the ends of the planks have respective plane central portions of width no greater than the width of the vertical upright, and flanked by two side chamfers forming an angle of about 45° with the plane end face. This prevents the facing portions of two planks connected at right angles to the vertical upright interfering with each other.

According to a fourth advantageous characteristic, the two opposite longitudinal edges of the planks have complementary engagement shapes of trapezoidal section. The adjacent edges of each superposed pair of planks interpenetrate to reinforce the strength of the assembly and to avoid leaving gaps between the superposed planks. It is essential to have clearance between these planks to accommodate the expansion that varies with atmospheric conditions. In addition, having planks with longitudinal edges that are trapezoidal in section means that when stressed the mechanical engagement presents good strength.

Each plank may be reinforced by an internal metal core having two ends each provided with a notch that bears on the corresponding tenon of a vertical upright. This improves the strength of the assembly and also of the planks themselves which can then act as load-carrying elements.

BRIEF DESCRIPTION OF THE DRAWINGS

Other characteristics and advantages of the invention appear on reading the following description of particular embodiments, given as non-limiting examples.

Reference is made to the accompanying drawings, in which:

FIG. 3 is a detail elevation view showing a plank on its own;

FIG. 4 is an end view along arrow IV in FIG. 3;

FIG. 5 is a bottom view seen along arrow V of FIG. 3;

FIG. 6 is a detail view in elevation of a segment of vertical upright;

FIG. 7 is a plan view seen along arrow VII of FIG. 6;

FIG. 8 is a detail view of the pin used for holding each tenon in the mortise in which it is received;

MORE DETAILED DESCRIPTION

Figure 1:
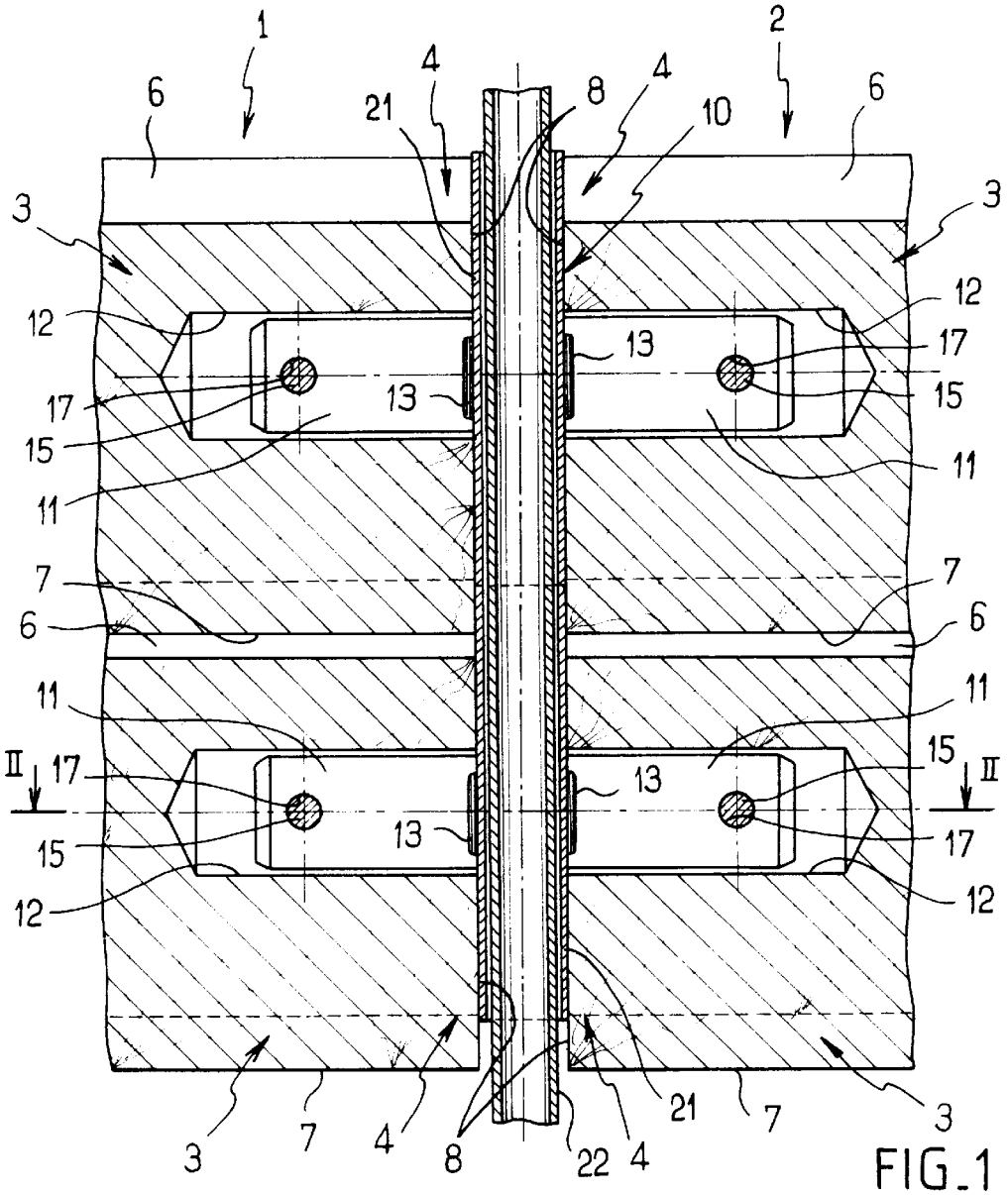
FIG. 1 is a section on a vertical plane through a device for assembling together two series of superposed planks constituting two wall panels that are disposed in line with each other.

FIGS. 1 to 6 show a device for assembling together two series 1, 2 of superposed wooden planks 3. Each of the two series 1, 2 of planks 3 constitutes a panel of a structure such as an outside wall or an inside partition.

As can be seen more clearly in FIGS. 3 to 5, each wooden plank 3 is in the form of a member of substantially rectangular section possessing two opposite ends 4 and two opposite longitudinal edges 6 and 7.

The ends 4 of each plank are identical, each having a plane central face 8 of width and two side chamfers 9 forming an angle a of about 45° with the end face 8.

The two opposite longitudinal edges 6, 7 of the planks 3 are of mutually-engageable complementary shapes: the edge 6 has a tongue of trapezoidal section and the edge 7 has a groove of corresponding trapezoidal section.

Figure 2:
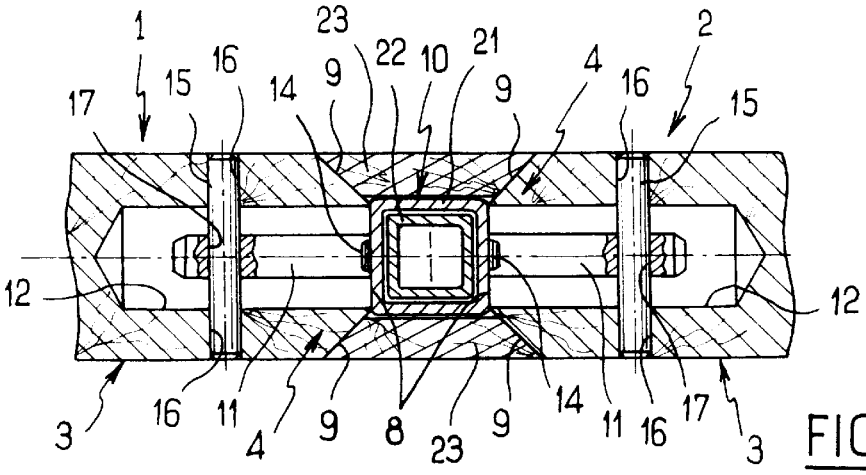
FIG. 2 is a section view on line II—II of FIG. 1.

As can be seen in FIG. 1, the planks 3 in each of the series 1, 2 are disposed in a vertical plane, with their long directions horizontal, and they are superposed edge-to-edge. The adjacent tongues and grooves 6, 7 of each pair of superposed planks 3 interpenetrate, thereby reinforcing the strength of the assembly while not leaving gaps between the planks 3. As shown in FIG. 2, the wall panels 1, 2 formed in this way are juxtaposed and interconnected via their side edges formed by the ends 4 of the planks 3, via a device of the invention. In the example shown in FIGS. 1 and 2, the two panels 1, 2 are placed in line with each other.

The assembly device of the invention comprises a metal vertical upright 10 fitted with fastener means for fastening the upright to one of the ends 4 of each of the planks 3. These fastener means comprise, for each series 1, 2 of superposed planks, a series of metal tenons 11 extending perpendicularly to the vertical upright 10 in a common vertical plane for the purpose of co-operating with mortises 12 formed in the corresponding ends 4 of the planks 3 concerned. Specifically, the upright 10 is a hollow square section member and the two series of tenons 11 are fixed on two opposite faces of the upright 10. The width of each face of the upright 10 is not less than the width of the end faces 8 of the planks 3.

In the example shown, the mortises 12 are implemented in the form of cylindrical bores, while the tenons 11 of the vertical upright 10 are implemented in the form of flat lugs of rectangular section, where the section has two long sides parallel to the vertical upright 10 and two short sides.

Each tenon 11 is fixed to the vertical upright by four weld beads 13, 14 formed on the long and short sides of the section of the tenon. Each weld bead is shorter than the corresponding side on which it is formed. The weld beads 13 and 14 do not extend over the angular portions of the tenon 11. This makes it possible to provide small clearance between the tenon 11 and the mortise 12, with the angular portions of the tenon 11 coming into contact with the cylindrical inside face of the mortise 12.

Each tenon 11 is held in the corresponding mortise 12 by a pin 15 passing through holes that are formed substantially in register through the plank 3 and through the tenon 11.

The hole 17 through the tenon 11 and the holes 16 through the plank 3 are slightly offset prior to the pin 15 being installed. The pin 15 has a conical end 18. In this example, the end is provided on a leading portion 19 that is separable from a main portion 15.1 of the pin 15 by virtue of a circular notch 20 forming a line of weakness. The length of the main portion 15.1 is approximately equal to the thickness of the plank 3.

The vertical upright 10 is made up of a plurality of segments 21 assembled end to end, and each fitted with one of the tenons 11 in each series of tenons. In the example shown in FIGS. 1 to 8, each length 21 is thus fitted with two tenons 11 disposed opposite each other.

The segments 21 are tubular and are engaged on a rod 22 forming a core which is common to all of the segments and which serves to assemble them together.

On assembly, each plank 3 is fixed to the segment 21 of upright 10 which is associated therewith either before or after the segment has been engaged on the rod 22 forming the core of the vertical upright 10. The corresponding tenon 11 is received in the mortise 12 of the plank 3 with little clearance and the end face 8 of the plank 3 is pressed against the segment 21. The holes 16 and 17 through the plank 3 and the tenon 11 are then slightly offset, with the hole 17 through the tenon 11 being set back from the holes 16 in the plank 3. The leading portion 19 of the pin 15 is then inserted into one of the holes 16 of the plank 3. The conical end 18 of the pin 15 penetrates into the hole 17 of the tenon 11, and, on being forced in, cause the holes 16 and 17 to come into register with the end face 8 of the plank 3 then being applied in prestressed manner against the segment 21 of the vertical upright 10.

Once the main portion 15.1 of the pin 15 has been pushed fully home into the plank 3, its leading portion 19 projects from one of the faces of the plank 3 and it is detached from the main portion 15.1 by breaking the pin starting from its zone of weakness formed by the circular notch 20.

Similarly, the plank 3 corresponding to the other wall panel is fixed to the segment 21 by means of the second tenon 11 thereof. Once assembly has been completed, a wooden cover 23 constituted by a strip of trapezoidal section can be placed between the side chamfers 9 at the ends 4 of the planks 3 and the wall panels 1 and 2, on either side of the vertical upright 10.

Figure 9:
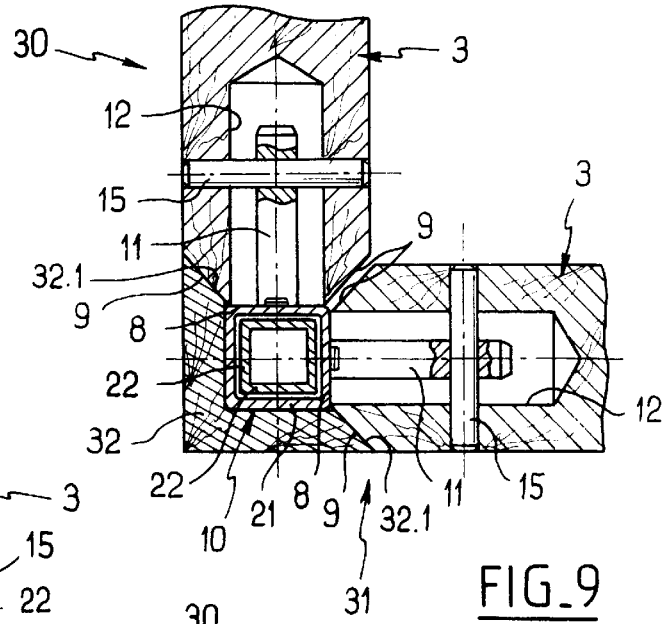
FIGS. 9, 10 and 11 are views analogous to FIG. 2, showing how assembly devices of the invention can be used with two, three, and four series of superposed wooden planks constituting two, three, and four wall panels that are respectively held together in L-shaped, T-shaped, and X-shaped configurations.
Figure 10:
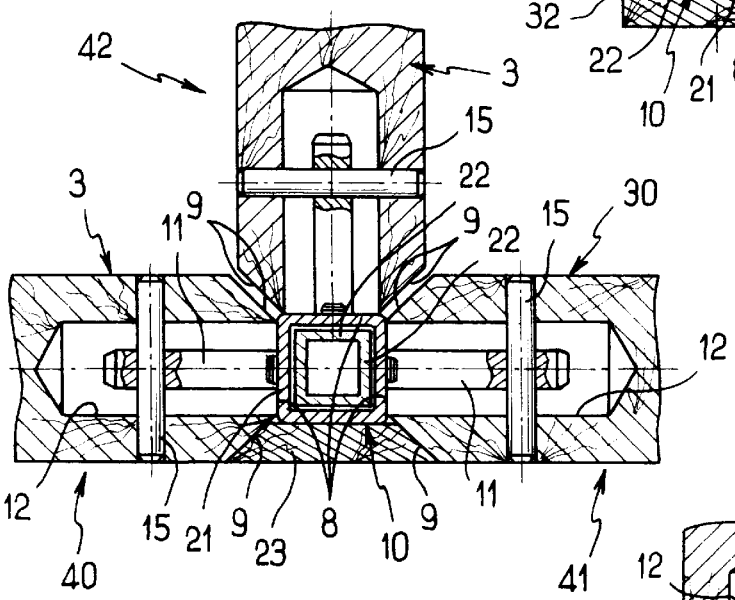
Figure 11:
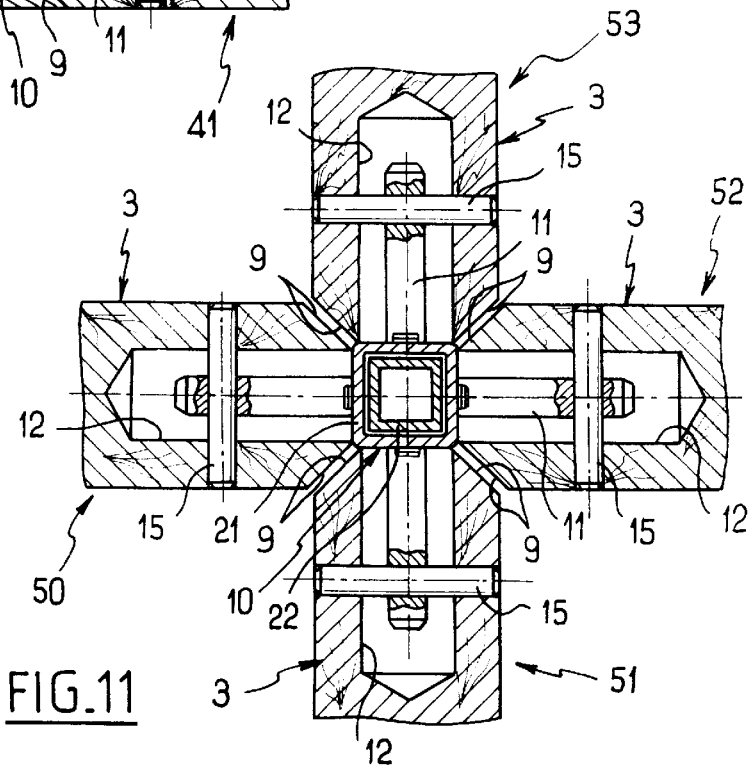

FIGS. 9 to 11 show three assembly devices of the invention, analogous to that described above with reference to FIGS. 1 to 8, and serving respectively to interconnect two wall panels 30 and 31 in an L-shaped configuration, three wall panels 40, 41, and 42 in a T-shaped configuration, and four wall panels 50, 51, 52, and 53 in an X-shaped configuration. The wall panels 30 and 31, 40 to 42, and 50 to 53 are made up in identical manner to the panels 1 and 2 of the embodiment described above with reference to FIGS. 1 to 8.

As before, the device comprises the vertical upright 10 made up of segments 21 disposed end to end and engaged on the rod 22.

In the embodiment shown in FIG. 9, the means for fastening the planks 3 to the vertical upright 10 comprise two series of tenons 11 extending in two vertical planes that are substantially perpendicular to each other. More precisely, the vertical upright 10 is square in section, and the two series of tenons 11 are fixed on two adjacent faces of the upright 10.

The fact of the width of the end face 8 of the planks 3 being slightly less than (and in any event no greater than) the width of the vertical upright 10, and of the side chamfers 9 at 45° being formed on either side of said face 8 ensures that there is no conflict between the planks 3 of the wall panels 30 and 31.

In addition, a wooden angle cover 32 is provided to cover the two unused faces of the vertical upright 10. This cover 32 is constituted by an angle section strip having chamfered ends 32.1 to marry with the corresponding chamfers 9 of the planks 3.

In the embodiment shown in FIG. 10, the means for fastening the planks 3 to the vertical upright 10 comprise three series of tenons 11 formed in three vertical planes forming, between them, two right angles. More precisely, since the vertical upright 10 is square in section, the three series of tenons 11 are fixed on three different faces of the upright 10. As before, the shape of the ends of the planks 3 having faces 8 narrower than the upright 10 and lateral chamfers 9 ensures that there is no conflict beLween the planks 3. In addition, a cover 23 identical to that described with reference to FIG. 2 is placed between the planks 3 of the panels 40 and 41.

In the embodiment shown in FIG. 11, the means for fastening the planks 3 to the vertical upright 10 comprise four series of tenons 11 disposed in four vertical planes that are mutually perpendicular in pairs. More precisely, the vertical upright 10 is square in section and each series of tenons 11 is fixed on one of the four faces of the upright 10. As before, the shape of the ends of the planks 3 ensures that there is no conflict between the planks of mutually adjacent wall panels.

In addition, in cases where only one, two, or three series of tenons 11 are fixed on one, two, or three faces of the vertical upright, it is possible to provide for the face or faces of the upright not provided with a series of tenons to be nevertheless provided with means for enabling one or more series of additional tenons to be installed quickly so that an extension or additional wall panel of the structure can be connected thereto subsequently. For example, each free face of the vertical upright may have tenon-receiving slots (not shown).

Figure 12:
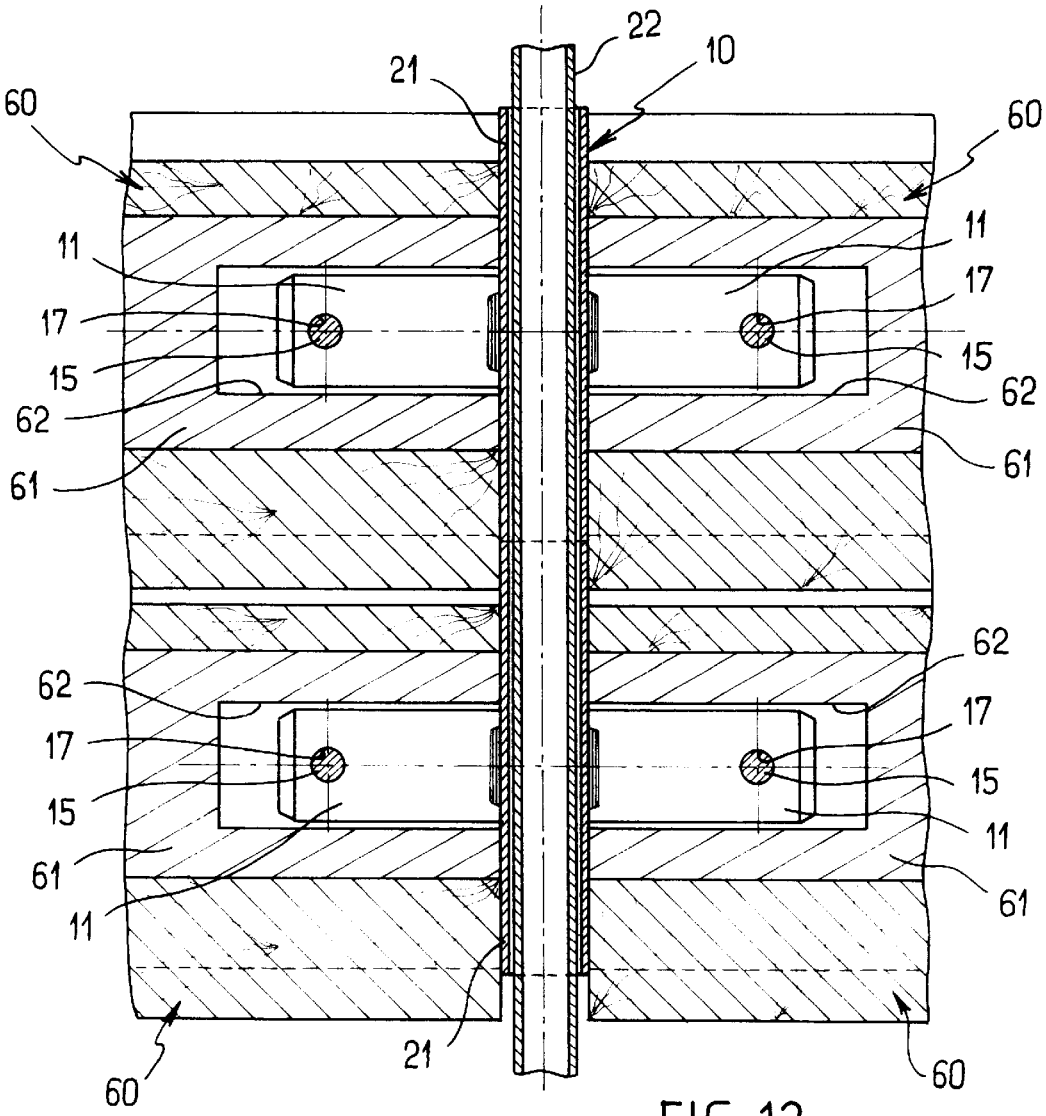
FIGS. 12, 13, and 14 are views analogous to FIGS. 1, 3, and 4, respectively, showing an improved variant embodiment of the invention.
Figure 13:
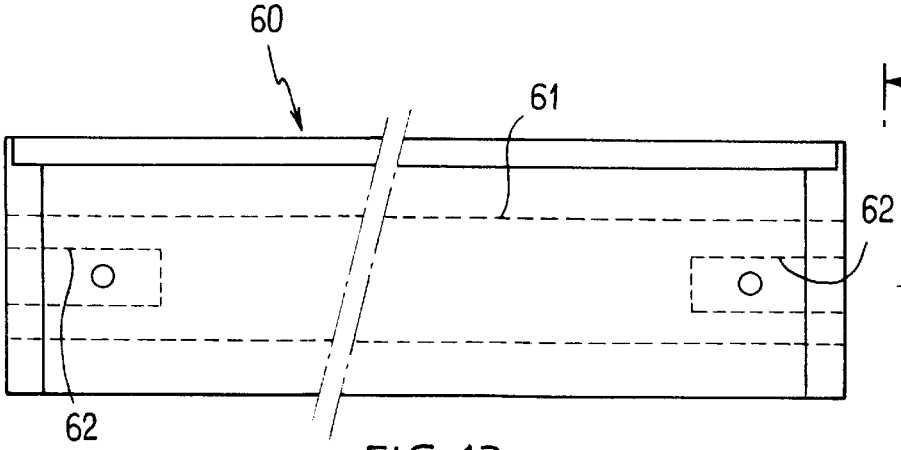
Figure 14:
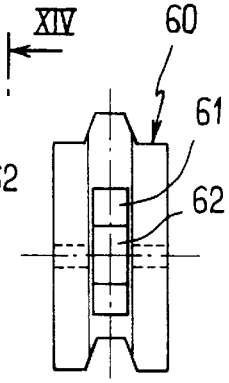

FIGS. 12 to 14 show a variant embodiment of the assembly device of the invention. As before, this device comprises the vertical upright 10 made up of segments 21 disposed end to end and engaged on the rod 22. In the example shown, two series of tenons 11 are fixed on two opposite faces of the vertical upright 10 to connect said upright to two panels of planks 3 that are in line with each other.

The structure of each plank, now given overall reference 60, is different from that of the planks 3 in the embodiments described above, in that each plank includes an internal metal reinforcing core 61. This core is constituted by a rectangular section strip embedded in the wood constituting the plank 60. At one of its ends, the core 61 has a notch 62 which receives the corresponding tenon 11. The metal cores 61 of the planks 60 thus co-operate with the metal vertical upright 10 and with the metal tenons 11 to constitute an entirely metal structure that is particularly rigid and strong and in which forces are taken up solely by elements that are made of metal. In particular, the metal cores 61 of the planks 60 can be used as elements for carrying a roof ridge beam or a floor slab.

Figure 15:
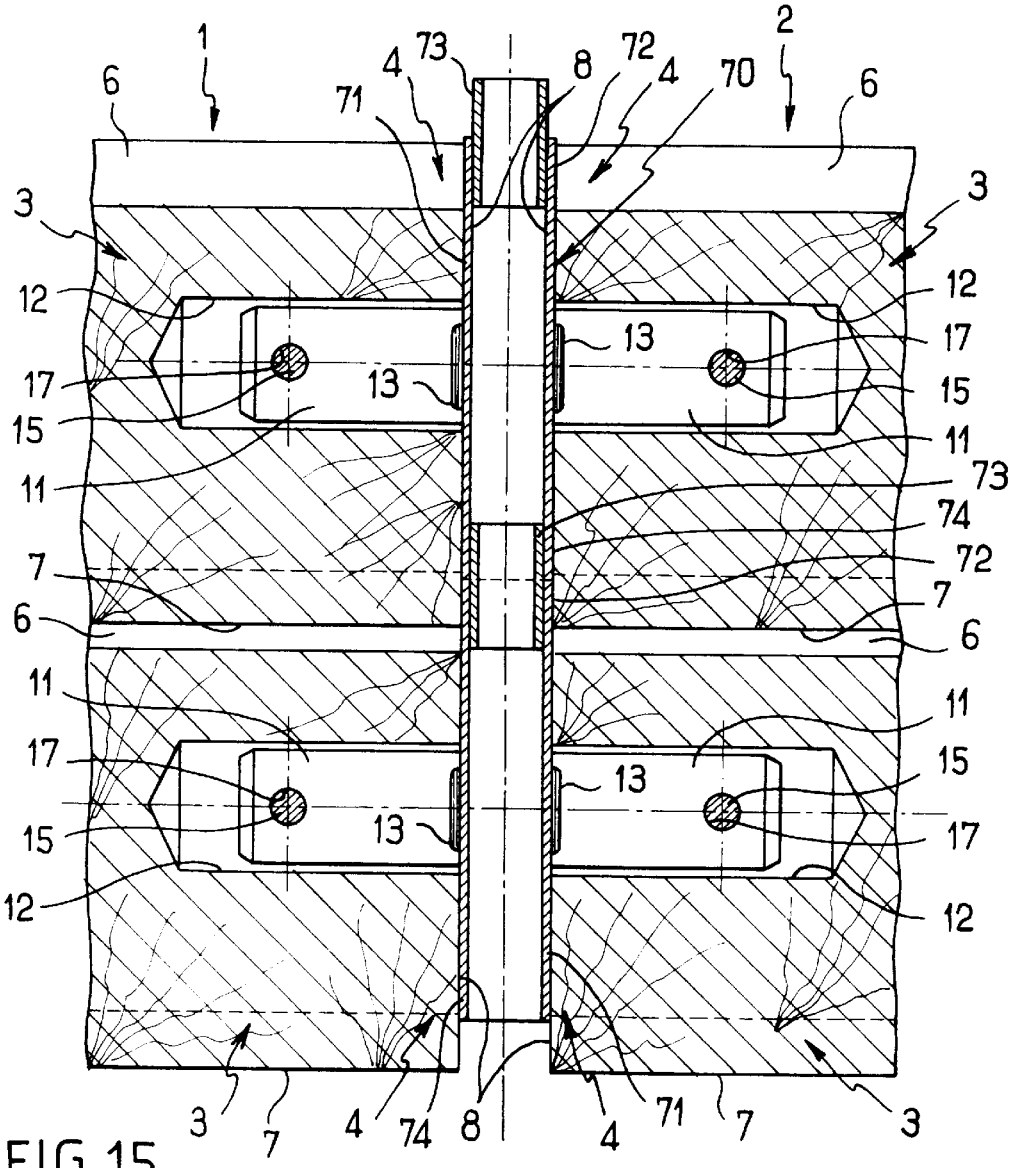
FIGS. 15 and 16 are views analogous to FIGS. 1 and 6 respectively, showing another variant embodiment of the invention.
Figure 16:
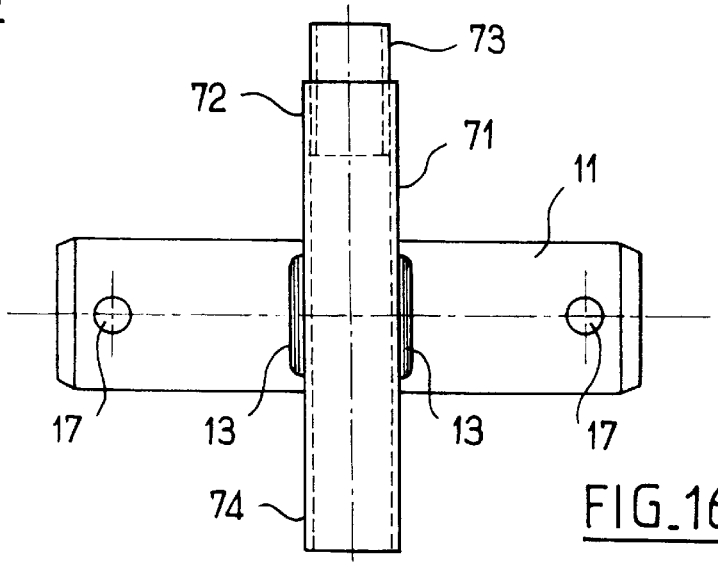

FIGS. 15 and 16 show another variant embodiment of the assembly device of the invention. This device differs from that described above with reference to FIGS. 1 to 6 in the structure of the vertical upright, which is now given overall reference 70.

The vertical upright 70 comprises a plurality of segments 71 connected end to end and each fitted with one of the tenons 11 in each series of tenons. However, unlike the above-described embodiment, the segments 71 are assembled together not by means of a single common core on which each segment is engaged, but in independent manner by complementary engagement means formed at the two ends of each segment 71. Specifically, each segment 71 is implemented in the form of a length of tube (of circular or polygonal section) having a male end 72 fitted with an engagement piece 73 and a female end 74 suitable for receiving the engagement piece 73 on the first end 72 of the adjacent segment 71 with small clearance. More precisely, the engagement piece 73 is constituted by a length of tube which is fixed in the male end 72 of the segment 71. A portion of said length of tube 73 is tightly mounted in the male end 72 of the segment 71, while the remaining portion of said length of tube projects from the segment 71 to be engageable in the female end 74 of the adjacent segment 71.

The segments 71 are assembled together to make up the vertical upright 70 in a manner that is thus extremely quick and simple, merely by engaging the segments via their ends.

Although not shown in the example of FIGS. 15 and 16, it is also possible to provide means for anchoring the segments 71 to one another. In particular, provision could be made to have segments 71 with a male end 72 that is threaded and a female end 74 that is tapped. Similarly, it is also possible, once assembly has been completed, to cause a bridging and/or reinforcing rod to be passed inside the segments 71 making up the vertical upright 70, said rod being secured to the top and to the bottom of the vertical upright 70.

I claim:

1. A wall panel comprising at least one series of wooden planks each having two opposite ends and two opposed longitudinal edges with the planks being superposed in an edge-to-edge configuration, a vertical upright having a plurality of tubular segments disposed end-to-end and each tubular segment having at least one tenon extending perpendicularly to the tubular segment, each tenon being received in a mortise in an end of one of the planks, and a fastener for fastening the tenon in the mortise.

2. A wall panel according to claim 1, wherein each of the tubular segments is engaged on a rod forming a core that is common to all of the segments.

3. A wall panel according to claim 1, wherein each of the tubular segments includes a tubular engagement portion projecting at one end of said tubular segment.

4. A wall panel according to claim 3, wherein said tubular engagement portion is fixed in one end said tubular segment.

5. A wall panel according to claim 1, wherein said fastener includes a pin passing through holes formed substantially in register in the plank and the tenon.

6. A wall panel according to claim 5, wherein the holes through the tenon and through the plank are offset when the end of the plank bears against the corresponding tubular segment, and wherein the pin has a conical end.

7. A wall panel according to claim 1, wherein the mortise is in the form of cylindrical bores and the tenons are in the form of flat lugs disposed in a plane parallel to the tubular segments.

8. A wall panel according to claim 1, wherein the tubular segments have a plane face from which the tenons project, and wherein each plank end has a plane central portion of width no greater than a width of the tubular segments and two lateral chamfers forming an angle of about 45° with the plane central portion.

9. A wall panel according to claim 1, wherein the two opposite longitudinal edges of each plank have complementary engagement shapes of trapezoidal section.

10. A wall panel according to claim 1, wherein each plank is reinforced by an internal metal core having two ends, each of which has a notch formed therein to receive the corresponding tenon of a tubular segment.

* * * * *